US007811442B2

(12) United States Patent
Holbrook et al.

(10) Patent No.: US 7,811,442 B2
(45) Date of Patent: Oct. 12, 2010

(54) METHOD AND APPARATUS FOR ANHYDROUS AMMONIA PRODUCTION

(75) Inventors: John H. Holbrook, Richland, WA (US); Jason C. Ganley, Washington, DC (US)

(73) Assignee: N H Three LLC, Richland, WA (US)

( * ) Notice: Subject to any disclaimer, the term of this patent is extended or adjusted under 35 U.S.C. 154(b) by 585 days.

(21) Appl. No.: 11/705,177

(22) Filed: Feb. 10, 2007

(65) Prior Publication Data

US 2008/0193360 A1 Aug. 14, 2008

(51) Int. Cl.
*C25B 1/00* (2006.01)
*C01C 1/04* (2006.01)

(52) U.S. Cl. ..... 205/552; 423/359

(58) Field of Classification Search ..... 423/352, 423/359, 362, 363; 422/148; 205/552
See application file for complete search history.

(56) References Cited

U.S. PATENT DOCUMENTS

| | | | | |
|---|---|---|---|---|
| 6,712,950 | B2 * | 3/2004 | Denvir et al. | 205/552 |
| 6,881,308 | B2 | 4/2005 | Denvir et al. | |
| 6,899,744 | B2 | 5/2005 | Iwahara et al. | |
| 7,157,166 | B2 | 1/2007 | Vajo | |
| 7,314,544 | B2 * | 1/2008 | Murphy et al. | 205/360 |
| 2003/0164305 | A1 * | 9/2003 | Denvir et al. | 205/360 |
| 2005/0087449 | A1 * | 4/2005 | Denvir et al. | 205/552 |
| 2006/0049063 | A1 * | 3/2006 | Murphy et al. | 205/552 |

FOREIGN PATENT DOCUMENTS

| | | | |
|---|---|---|---|
| EP | 0972855 A1 | * | 1/2000 |
| JP | 08-066621 A | * | 3/1996 |
| JP | 8-246177 | * | 9/1996 |

OTHER PUBLICATIONS

Li et al., "Preparation of double-doped BaCeO3 and its application in the synthesis of ammonia at atmospheric pressure," 2007, Science and Technology of Advanced Materials, 8, pp. 566-570.*

(Continued)

*Primary Examiner*—Wayne Langel
*Assistant Examiner*—Brittany M Martinez
(74) *Attorney, Agent, or Firm*—Douglas E McKinley, Jr.

(57) ABSTRACT

A method and apparatus for synthesizing anhydrous ammonia utilizing proton conducting electrolyte having a water vapor dissociating electrocatalyst on one side and a nitrogen dissociating electrocatalyst on the other side. A voltage is provided across the proton conducting electrolyte, protons are separated from the water vapor and transferred through the middle of the proton conducting electrolyte to the second side of the proton conducting electrolyte. Nitride ions are formed from nitrogen and the electrons provided by the voltage on the second side of the proton conducting electrolyte. The protons are then reacted with the nitride ions on the second side of the proton conducting electrolyte to produce anhydrous ammonia. A preferred proton conducting electrolyte is barium cerium oxide doped with about 10% ytterbium with a water vapor dissociating electrocatalyst of Ni and Pd, and a nitrogen dissociating electrocatalyst of Co and Ru.

21 Claims, 2 Drawing Sheets

OTHER PUBLICATIONS

Li et al., "A novel method for preparation of doped Ba3(Ca1.18Nb1.82)O9_d: Application to ammonia synthesis at atmospheric pressure," 2005, Solid State Ionics, 176, pp. 1063-1066.*

Liu et al., "Synthesis of ammonia at atmospheric pressure with Ce0.8M0.2O2_d (M= La, Y, Gd, Sm) and their proton conduction at intermediate temperature," 2006, Solid State Ionics, 177, pp. 73-76.*

Xie et al., "Preparation of La1.9Ca0.1Zr2O6.95 with pyrochlore structure and its application in synthesis of ammonia at atmospheric pressure," 2004, Solid State Ionics, 168, pp. 117-121.*

E. Andrew Payzant, Scott A. Speakman, and Timothy R. Armstrong, "Novel High-Temperature Ion Transport Membrane Development," DOE Hydrogen Program FY 2005 Progress Report.

Jerry Y.S. Lin, "Proton-Conducting Dense Ceramic Membranes for Hydrogen Separations," Annual Report, Nov. 2001.

G. Marnellos, S. Zisekas, M. Stoukides, "Synthesis of Ammonia at Atmospheric Pressure with the Use of Solid State Proton Conductors," Journal of Catalysis, 193, p. 80 (2000).

Xiwang Qi and Y.S. Lin, "Electrical Conducting Properties of Proton-Conducting Terbium-Doped Strontium Cerate Membranes," Solid State Ionics, 120, p. 85, 1999.

A. Nowick, A. Vaysleyb, "Isotope effect and proton hopping in high-temperature protonic conductors", Solid State Ionics, 97, p. 17, 1997.

H. Iwahara, Y. Asakura, K. Katahira, M. Tanaka, "Prospect of hydrogen technology using proton-conducting ceramics," Solid State Ionics, 168, p. 299, 2004.

Y. Arachi, H. Sakai, O. Yamamoto, Y. Takeda, N. Imanishi, "Electrical conductivity of the ZrO2-Ln2O3 (Ln=lanthanides) system," Solid State Ionics, 121, p. 133, 1999.

V. Kordali, et al, "Electrochem. Syn. of Amm. at Atmospheric Pres. & Low Temp . . . ," J. Royal Soc. Chem., Chem Com., p. 1673, 2000.

J.C. Ganley, et al, "Porous Anodic Alumina Optimized as a Catalyst Support for Microreactors", Journal of Catalysis, 227, p. 26, 2004.

T. Murakami, et al, "Electrolytic Ammonia Synthesis from Water and Nitrogen Gas in Molten Salt under Atmospheric Pressure," Electrochimica Acta, 50, p. 5423, 2005.

S. Doong, et al, "Direct Hydrogen Production from Coal Using Novel Membrane Gasifier," Final Technical Report, Gas Tech. Inst. Sep. 2003 to Nov. 2004.

J. Wainright, J. Wang, D. Weng, R. Savinell, M. Litt, "Acid-doped polybenzimidazoles: a new polymer electrolyte," Journal of the Electrochemical Society, 142 , L121, 1995.

Y. Jiang, A. Virkar, "A high performance, anode-supported solid oxide fuel cell operating on direct alcohol," Journal of the Electrochemical Society, 148, A706, 2001.

H. Iwahara, et al, "Proton cond. in sintered oxides & its application to steam elect. for hydrogen prod.," Solid State Ionics, ¾, p. 359, 1981.

H. Iwahara, H. Uchida, K. Ono, K. Ogaki, "Proton conduction in sintered oxides based on barium cerate (BaCeO3)," Journal of the Electrochemical Society, 135, p. 529, 1988.

T. Yajima, H. Kazeoka, T. Yogo, H. Iwahara, "Proton conduction in sintered oxides based on calcium zirconate (CaZrO3)," Solid State Ionics, 47, p. 271, 1991.

J. Ganley, et al, "A Priori Catalytic Activity Correlations: The Difficult Case of Hydrogen Production from Ammonia," Catalysis Letters, 96 (3), p. 117, 2004.

S. Zisekas, G. Karagiannakis, G. Marnellos, and M. Stoudikes, "Study of Ammonia Decomposition in a Proton Conductiong Solid Electrolyte Cell," Ionics, 8, p. 118, 2002.

T. Murakami, et al, "Electrolytic Amm. Syn. Directly from Various Hydrogen Sources under Atmospheric Pressure," Electrochemical & Solid State Letters, 8, D12, 2005.

B.H. Wang, et al, "Syn. of amm. from nat. gas at atm. Pressure . . . ," J. Solid State Electrochem., 11, p. 27, 2006.

H. Matsumoto, et al, "Electrochemical Hydrogen Pump Using a High-Temperature-Type Proton Conductor: Improvement of Pumping Capacity," Solid State Ionics, 145, p. 25, 2001.

I.I. Balachov, et al, "Modular System for Hydrogen Generation & Oxygen Recovery," DOE Hydrogen Program FY 2005 Progress Report, p. 363.

J.S. Herring, et al, "Laboratory-Scale High Temperature Electrolysis System," DOE Hydrogen Program FY 2006 Progress Report, p. 173.

* cited by examiner

METHOD AND APPARATUS FOR ANHYDROUS AMMONIA PRODUCTION

TECHNICAL FIELD

This invention relates to a method and apparatus for anhydrous ammonia production. More specifically, this invention relates to a method and apparatus for producing anhydrous ammonia by separating protons from water vapor on one side of a proton conducting electrolyte, transferring the protons through the proton conducting electrolyte, and then reacting the protons with nitride ions formed from nitrogen on the other side of the proton conducting electrolyte to produce anhydrous ammonia.

BACKGROUND OF THE INVENTION

Ammonia is a compound of hydrogen and nitrogen with the chemical formula $NH_3$. In commercial applications, ammonia is often provided as anhydrous ammonia, which simply means that the ammonia is not dissolved in water, or as part of a different compound, such as ammonium nitrate or urea. The main uses of ammonia are in the production of fertilizers, explosives and polymers. Because of its many uses, there are dozens of chemical plants worldwide that produce ammonia. The United States Geological Survey estimates that worldwide ammonia production in 2004 was 109 million metric tonnes. The People's Republic of China produced 28.4% of the worldwide production, followed by India with 8.6%, Russia with 8.4%, and the United States with 8.2%. About 80% or more of the ammonia produced is used for fertilizing agricultural crops.

Recently, ammonia has been suggested as a substitute for carbon based fuel sources, such as gasoline, diesel fuel, natural gas, and coal. Numerous potential benefits might be achieved by using ammonia as a fuel. For example, previous studies such as G. Marnellos, S. Zisekas, M. Stoukides, "*Synthesis of Ammonia at Atmospheric Pressure with the Use of Solid State Proton Conductors*," Journal of Catalysis, 193, 80 (2000) have described the electrocatalytic solid-state synthesis of ammonia starting from hydrogen and nitrogen gases. Numerous studies under the United States Department of Energy Hydrogen Program have also investigated the solid-state electrolysis of steam for the production of hydrogen. J. S. Herring, J. E. O'Brien, C. M. Stoots, K. DeWall, M. McKellar, E. Harvego, M. Sohal, G. L. Hawkes, and R. Jones, "*Laboratory Scale High Temperature Electrolysis System*", DOE Hydrogen Program FY 2006 Progress Report, page 173 and I. I. Balachov, S. Crouch-Baker, M. Hornbostel, M. McKubre, A. Sanjurjo, and F. Tanzella, "*Modular System for Hydrogen Generation and Oxygen Recovery*", DOE Hydrogen Program FY 2006 Progress Report, page 363. Unfortunately, these approaches have not been shown to be economically viable when compared to traditional methods of ammonia production, principally as a result of the cost of the energy used to form hydrogen from water. Still, since nitrogen is available from the atmosphere, and hydrogen is available in water, ammonia can theoretically be produced anywhere on earth. Using ammonia as a substitute for petroleum based energy sources could therefore, in theory, lessen the dependence on foreign countries to supply energy, provided that more efficient production methods were found.

Since burning ammonia does not produce carbon dioxide, using ammonia as a fuel source also has potential benefits to the environment. Unfortunately, however, current technologies for commercial scale ammonia production do not rely on water and air as inputs. Instead, these commercial facilities generally consume significant quantities of carbon based fuels, thereby counteracting at least some of the potential benefits that could be achieved by using ammonia as a fuel.

Modern ammonia-producing plants typically utilize some variation of the Haber-Bosch process to produce ammonia from the nitrogen contained in the air. The process, developed by Fritz Haber and Carl Bosch in 1909 and patented in 1910, first converts carbonaceous chemical feed stocks, such as natural gas, (methane), coal, liquified petroleum gas (propane and butane), or petroleum naphtha, into gaseous hydrogen. Catalytic steam reforming is then used to form hydrogen plus carbon monoxide, for example in steam reforming of methane:

$$CH_4+H_2O \rightarrow CO+3H_2$$

The next step then uses catalytic shift conversion to convert the carbon monoxide to carbon dioxide and more hydrogen:

$$CO+H_2O \rightarrow CO_2+H_2$$

To produce the desired end-product ammonia, the hydrogen is then catalytically reacted with nitrogen (derived from process air) to form anhydrous liquid ammonia.

$$3H_2+N_2 \rightarrow 2NH_3$$

In modern ammonia plants using the Haber-Bosch process, a variety of other steps are also typically performed, such as removing sulfur from the carbonaceous feed stock. Typically, the energy necessary to perform all of these operations is provided by burning the carbonaceous fuels, typically natural gas. As a result, modern ammonia production facilities typically create massive amounts of carbon dioxide, because they are producing carbon dioxide from the burning of carbon based fuels to provide both the energy and hydrogen necessary to promote the Haber-Bosch and related processes. As a result of the widespread use of these prior art methods, while ammonia is the fifth most abundantly produced chemical in the United States, it ranks number two on the list of chemicals requiring the most energy to produce, according to estimates from the United States Department of Energy. Most, if not all, of the carbon dioxide produced in world-wide ammonia production is ultimately vented to the atmosphere.

Over the course of the past two decades, a consensus has emerged among the global scientific community that carbon dioxide in the atmosphere has the unfortunate effect of allowing sunlight to pass through and warm the earth's surface, but then traps the radiant energy created by that warming, and preventing it from escaping through the earth's atmosphere back into space. There is also a general consensus among scientists that this condition, generally termed the "greenhouse effect," is gradually raising the average temperature of the earth's atmosphere and oceans, which in turn is creating highly detrimental consequences, including but not limited to, raising sea levels at or near highly populated coastal regions, and unusually severe weather, droughts, floods, tornadoes, storms, hurricanes and typhoons, and the like. It has been estimated that the costs of global warming caused by the greenhouse effect will eventually run into the trillions of dollars, and some commentators believe that unless global warming is somehow reversed, it will ultimately result in the deaths of billions of people throughout the world.

Accordingly, there exists a need for new energy sources, such as ammonia, that do not generate so-called "greenhouse gasses" such as carbon dioxide, when they are burned. There is a further need for new sources of energy, such as ammonia, which may be produced domestically, to lessen the dependence on foreign suppliers. Finally, even if the use of ammonia as a fuel is ignored, there is still a need for new methods of producing ammonia for use as fertilizer that do not require carbon based fuels as energy sources and/or as the hydrogen source, as is typical in the Haber-Bosch process. The present invention addresses all of these needs simultaneously.

SUMMARY OF THE INVENTION

Accordingly, it is an object of the present invention to provide a method of producing ammonia that does not produce carbon dioxide as a byproduct. It is a further object of the present invention to provide a method of producing ammonia that uses only water, electrical power and air as inputs, and which is more economical than prior art methods. It is yet another object of the present invention is to provide a method for producing ammonia that may be operated with only green power sources, such as wind turbines, hydroelectric dams, solar power, and nuclear power plants.

These and other objectives are met by providing a method and apparatus for synthesizing anhydrous ammonia. As will be recognized by those having ordinary skill in the art, any method that allows the production of anhydrous ammonia also allows the production of ammonia dissolved in water, or ammonia in combination with other chemicals, such as urea. Accordingly, while the present invention is described as a method for producing anhydrous ammonia, the present invention should be understood to also enable the production of ammonia in all its forms, including ammonia dissolved in water, and ammonia in combination with other elements and/or chemicals.

The present invention accomplishes these objectives by providing a proton conducting electrolyte having a first side, a middle, and a second side. Normally, the term "proton conduction" means protons are conducted through a material and converted to hydrogen gas at the other side, as described in "Phillippe Colomban," Editor "*Proton Conductors, Solids, Membranes and Gels, Materials and Devices*" Cambridge University Press, 1992. As used herein however, "proton conduction" does not require the conversion of the proton to hydrogen. Accordingly, as used herein "proton conducting electrolyte" means any material that transmits protons from one side of the material to the other in response to a driving force, regardless or whether such protons are converted to hydrogen on the other side.

In the present invention, protons are provided from hydrogen from water molecules, where the electron has been separated from one or both of the hydrogen atoms. It is preferred that no hydrogen production occur on the other side of the material, however, it should be understood that some production of hydrogen may be present. "Proton conducting electrolyte" as used herein includes, but is not limited to, ceramics, cermets, metals, acids, superacids, and polymers (including but not limited to nafion), whether in solid, liquid, or gel form.

At least a portion of the first side of the proton conducting electrolyte is provided in contact with a water vapor dissociating electrocatalyst. Preferably, substantially all of the first side of the proton conducting electrolyte is provided in contact with a water vapor dissociating electrocatalyst. It is further preferred that the water vapor dissociating electrocatalyst preferentially decomposes water vapor in favor of adsorbing oxygen. The second side of the proton conducting electrolyte is provided in contact with a nitrogen dissociating electrocatalyst, and preferably with a nitrogen dissociating electrocatalyst that preferentially dissociates diatomic nitrogen in favor of dissociating ammonia.

A voltage is provided across the proton conducting electrolyte. By exposing the first side of the proton conducting electrolyte (coated with an appropriate electrocatalyst) to water vapor, and exposing the second side of the proton conducting electrolyte (coated with a nitrogen dissociating electrocatalyst) to nitrogen, protons are separated from the water vapor, transferred through the middle of the proton conducting electrolyte to the second side of the proton conducting electrolyte. Nitride ions are formed from nitrogen and the electrons provided by the voltage on the second side of the proton conducting electrolyte. The protons are then reacted with the nitride ions on the second side of the proton conducting electrolyte to produce anhydrous ammonia.

As used herein "water vapor" includes humidity, gaseous water, subcritical steam and superheated steam.

Preferably, while not meant to be limiting, exposing the first side of the proton conducting electrolyte to water vapor is performed at a pressure and temperature sufficient to substantially prevent condensation of water. Exposing the second side of the proton conducting electrolyte to nitrogen is preferably performed at a pressure of between about 10 atm and about 300 atm. Exposing the first side of the proton conducting electrolyte to water vapor is preferably performed at a temperature of between about 400° C. and about 800° C. Exposing the first side of the proton conducting electrolyte to water vapor is preferably performed at substantially the same pressure as the step of exposing the second side of the proton conducting electrolyte to nitrogen.

The proton conducting electrolytes used in the present invention are preferably selected from the group of perovskites having a dopant. Preferred perovskites are selected as perovskites having the form $ABO_3$ where A is an element that forms a divalent cation, B is an element that forms a quadravalent cation, and a portion of B is replaced with a dopant. A is preferably selected from the alkaline earth elements, Be, Mg, Ca, Sr, Ba, other elements that form divalent cations, Fe, Co, Ni, Cu, Zn, and combinations thereof. B is preferably selected from the group IVB transition metals, Ti, Zr, Hf, the group IVA metals, C, Si, Ge, Sn, Pb, other elements that form quadravalent cations, Mn, Mo, Re, Os, Ce, and combinations thereof. The dopant is preferably selected from the lanthanide series of rare earth elements, La, Ce, Pr, Nd, Pm, Sm, Eu, Gd, Tb, Dy, Ho, Er, Tm, Yb and the group 111B of the transition metals, Sc, Y, Lu, the group IIIA metals B, Al, Ga, In, the group VA metals Sb, Bi, the group VIB element Cr, the group VIIIB elements Fe, Ru, Os, the group IXB elements Co, Rh, Ir, and combinations thereof.

As used herein "water vapor dissociating electrocatalyst" means an electrically conducting material that promotes the decomposition of water molecules. Preferred water vapor dissociating electrocatalysts include, but are not limited to, Pt, Pd, Ni, Co, Cu, Ag, W, Os, Ru, Rh, Ir, Cr, Fe, Mo, V, Re, Mn, Nb, Ta, oxides and sulfides of the forgoing, and alloys of these metals and their oxides and sulfides. As used herein "nitrogen dissociating electrocatalyst" means an electrically conducting material that promotes the decomposition of nitrogen molecules. Preferred nitrogen dissociating electrocatalysts include, but are not limited to, Pt, Pd, Ni, Co, Cu, Ag, W, Os, Ru, Rh, Ir, Cr, Fe, Mo, V, Re, Mn, Nb, Ta, oxides and sulfides of the forgoing, and alloys of these metals and their oxides and sulfides. It is preferred that the nitrogen dissociating electrocatalysts preferentially decompose nitrogen in favor of decomposing ammonia.

The voltage is preferably applied across the proton conducting electrolyte by using the water vapor dissociating electrocatalyst and the nitrogen dissociating electrocatalyst as electrodes. While any geometry may be used for the proton conducting electrolyte, tubular and planer geometries are preferred.

For the purposes of promoting an understanding of the principles of the invention, reference will now be made to the embodiments illustrated in the drawings. Specific language will be used to describe the same. It will nevertheless be understood that no limitations of the inventive scope is thereby intended, as the scope of this invention should be evaluated with reference to the claims appended hereto. Alterations and further modifications in the illustrated devices, and such further applications of the principles of the invention as illustrated herein are contemplated as would normally occur to one skilled in the art to which the invention relates.

BRIEF DESCRIPTION OF THE DRAWINGS

The following detailed description of the embodiments of the invention will be more readily understood when taken in conjunction with the following drawing, wherein.

DETAILED DESCRIPTION OF THE PREFERRED EMBODIMENTS

Figure 1:
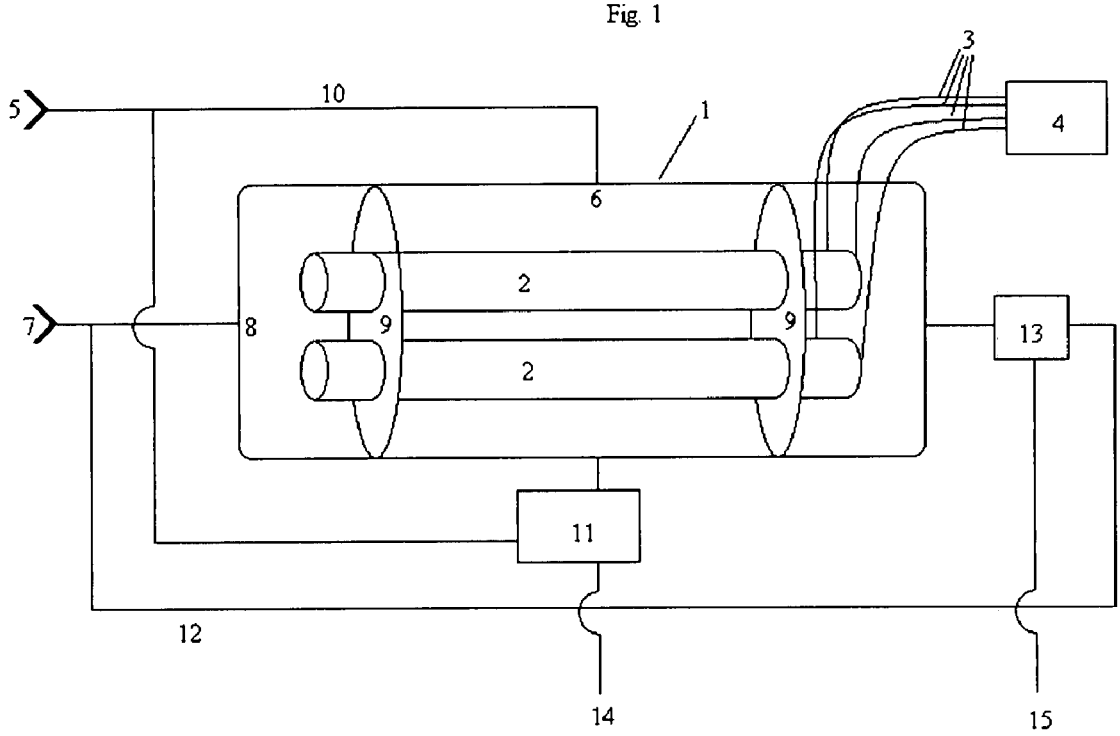
FIG. 1 is a schematic illustration of a preferred embodiment of the apparatus of the present invention.

For the purposes of promoting an understanding of the principles of the invention, a preferred embodiment is illustrated. As shown in FIG. 1, the present invention includes an apparatus for synthesizing anhydrous ammonia. The apparatus includes a process chamber 1 containing a proton conducting electrolyte 2 having a first side and a second side. While not meant to be limiting, in the embodiment shown in FIG. 1, the proton conducting electrolyte 2 is shown in a tubular arrangement, such that the first side is the exterior of the tube and the second side is the interior of the tube. Circuitry 3, including a power source 4, is configured to provide a voltage across the proton conducting electrolyte 2. A water vapor source 5 is in communication with a water vapor inlet 6 for allowing a flow of water vapor from the water vapor source 5 into the process chamber 1 and to the first side of the proton conducting electrolyte 2. A nitrogen source 7, is in communication with a nitrogen inlet 8 for allowing a flow of nitrogen from the nitrogen source 7 into the process chamber 1 to the second side of the proton conducting electrolyte 2. As shown in the Figure, baffles 9 keep the flow of water vapor separated from the flow of nitrogen.

Water vapor is preferably provided in a first loop 10, which allows water vapor to be exposed to the proton conducting electrolyte 1, and for unreacted water vapor to be recirculated back to the proton conducting electrolyte 1. Protons separated from the water vapor are passed through the proton conducting electrolyte 1 from the first, exterior, side to the second, interior, side of proton conducting electrolyte 1. Oxygen formed by decomposing water vapor is separated from the water vapor present in the first loop 10 by an oxygen separator 11. The oxygen separator 11 may be any known in the art, but is preferably selected from the group oxygen permeable membranes, a condensation unit, a drying unit, an adsorption unit, a oxidation reaction bed, and combinations thereof. Oxygen is then removed from first loop 10 by oxygen drain 14.

Nitrogen is preferably provided in a second loop 12, which allows nitrogen to be exposed to the proton conducting electrolyte 1, and for unreacted nitrogen to be recirculated back to the proton conducting electrolyte 1. Nitride ions are formed from nitrogen and the electrons provided by the voltage on the second side of the proton conducting electrolyte 1. Ammonia is then formed by the reaction of nitride ions and protons on the interior surface of the proton conducting electrolyte 1. Ammonia is then separated from the nitrogen present in the second loop 10 by an ammonia separator 13. The ammonia separator 13 may be any known in the art, and is preferably selected from the group of condensers, separation membranes, water trap units, an aqueous ammonia bath, and combinations thereof. Ammonia formed on the interior surface of the proton conducting electrolyte 1 is removed from second loop by ammonia drain 15.

Figure 2:
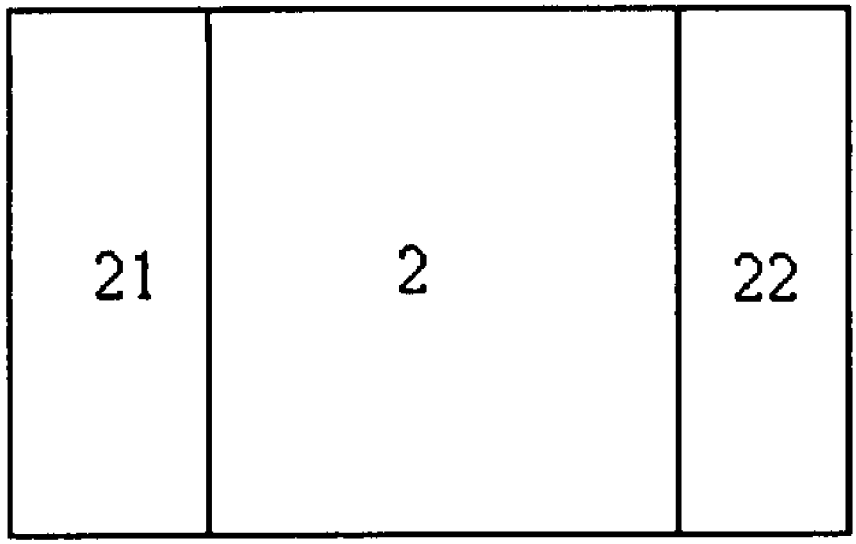
FIG. 2 is a cutaway view of the proton conducting electrolyte of the present invention showing the first side, the middle, and the second side.

FIG. 2 is a cutaway view of a cross section of the proton conducting electrolyte 1. This view is of either a tubular or a planer geometry. As shown in FIG. 2, the proton conducting electrolyte 2 consists of three layers. The first side is formed of a water vapor dissociating electrocatalyst 22. The middle section is made of a proton conducting electrolyte 2, and the second side is formed of a nitrogen dissociating electrocatalyst 23. The water vapor dissociating electrocatalyst 22 and nitrogen dissociating electrocatalyst 23 are utilized as electrodes by connecting circuitry 3, powered by a power source 4, to provide a voltage across the proton conducting electrolyte 2.

The water vapor dissociating electrocatalyst 22 is preferably selected from the group of Pt, Pd, Ni, Co, Cu, Ag, W, Os, Ru, Rh, Ir, Cr, Fe, Mo, V, Re, Mn, Nb, Ta, oxides and sulfides of the forgoing, and alloys of combinations thereof. The nitrogen dissociating electrocatalyst is preferably selected from the group of Pt, Pd, Ni, Co, Cu, Ag, W, Os, Ru, Rh, Ir, Cr, Fe, Mo, V, Re, Mn, Nb, Ta, oxides and sulfides of the forgoing, and alloys of combinations thereof.

Most preferred is a proton conducting electrolyte of barium cerium oxide doped with about 10% ytterbium, having having a first side formed of a water vapor dissociating electrocatalyst of Ni, Pd, and combinations thereof, and a second side formed of a nitrogen dissociating electrocatalyst of Co, Ru, and combinations thereof.

As shown and described herein, the present invention provides significant advantages when compared to prior art methods. Specifically, the current process provides significant gains in efficiency when compared to past electrolytic and electrocatalytic ammonia synthesis approaches by eliminating the need to generate hydrogen gas as an interim product. For example, in T. Kobayashi, K. Abe, Y. Ukyo, H. Matsumoto, *Solid State Ionics,* 138, 243 (2001) the authors describe a study of the efficiency of steam electrolysis using a perovskite proton conductor which demonstrated an overall current efficiency of 76%. This current efficiency is higher than those widely published by the United States Department of Energy for the electrolysis of steam using an oxide-conducting electrolyte of approximately 41-64%.

When this energy efficiency is considered in series with the current efficiency reported for the synthesis of ammonia (78% as described in Marnellos et al.), one would expect an overall process current efficiency of 76%×78%=59.3% overall efficiency.

Combining the two steps in the single cell, as is done in the present invention, exhibits the same range of current efficiency for these other high-temperature solid-state electrocatalytic processes (70-80%) in a single step. As such, a significant overall process efficiency improvement is achieved by avoiding the inherent waste of energy caused by successive process steps.

While the invention has been illustrated and described in detail in the drawings and foregoing description, the same is to be considered as illustrative and not restrictive in character. Only certain embodiments have been shown and described, and all changes, equivalents, and modifications that come within the spirit of the invention described herein are desired to be protected. Any experiments, experimental examples, or experimental results provided herein are intended to be illustrative of the present invention and should not be considered limiting or restrictive with regard to the invention scope. Further, any theory, mechanism of operation, proof, or finding stated herein is meant to further enhance understanding of the present invention and is not intended to limit the present invention in any way to such theory, mechanism of operation, proof, or finding.

Thus, the specifics of this description and the attached drawings should not be interpreted to limit the scope of this invention to the specifics thereof. Rather, the scope of this invention should be evaluated with reference to the claims appended hereto. In reading the claims it is intended that when words such as "a", "an", "at least one", and "at least a portion" are used there is no intention to limit the claims to only one item unless specifically stated to the contrary in the claims. Further, when the language "at least a portion" and/or "a portion" is used, the claims may include a portion and/or the entire items unless specifically stated to the contrary. Finally, all publications, patents, and patent applications cited in this specification are herein incorporated by reference to the extent not inconsistent with the present disclosure as if each were specifically and individually indicated to be incorporated by reference and set forth in its entirety herein.

We claim:

1. A method for synthesizing anhydrous ammonia comprising the steps of:

a. providing a proton conducting electrolyte having a first side and a second side, wherein at least a portion of the first side of the proton conducting electrolyte is provided in contact with a water vapor dissociating electrocatalyst and at least a portion of the second side of the proton conducting electrolyte is provided in contact with a nitrogen dissociating electrocatalyst, b. providing a voltage across the proton conducting electrolyte, c. exposing the first side of the proton conducting electrolyte to water vapor, and d. exposing the second side of the proton conducting electrolyte to nitrogen at a pressure of between about 10 atm and about 300 atm.

2. The method of claim 1 wherein the step of exposing the first side of the proton conducting electrolyte to water vapor is performed at a pressure and temperature sufficient to substantially prevent condensation of water.

3. The method of claim 1 wherein the step of exposing the first side of the proton conducting electrolyte to water vapor is performed at a temperature of between about 400° C. and about 800° C.

4. The method of claim 1 wherein the step of exposing the first side of the proton conducting electrolyte to water vapor is performed at substantially the same pressure as the step of exposing the second side of the proton conducting electrolyte to nitrogen.

5. The method of claim 1 wherein the proton conducting electrolyte is a perovskite having a dopant.

6. The method of claim 5 wherein the perovskite having a dopant is in the form $ABO_3$ where A is an element that forms a divalent cation, B is an element that forms a quadravalent cation, and a portion of B is replaced with a dopant.

7. The method of claim 6 wherein A is selected from the group consisting of alkaline earth elements, other elements that form divalent cations, and combinations thereof, and B is selected from the group consisting of IVB transition metals, the group IVA metals, other elements that form quadravalent cations, and combinations thereof.

8. The method of claim 7 wherein the dopant is selected from the group consisting of La, Ce, Pr, Nd, Pm, Sm, Eu, Gd, Tb, Dy, Ho, Er, Tm, Yb, Sc, Y, Lu, B, Al, Ga, In, Sb, Bi, Cr, Fe, Ru, Os, Co, Rh, Ir, and combinations thereof.

9. The method of claim 1 wherein the water vapor dissociating electrocatalyst preferentially decomposes water vapor in favor of adsorbing oxygen.

10. The method of claim 9 wherein the water vapor dissociating electrocatalyst is selected from the group consisting of Pt, Pd, Ni, Co, Cu, Ag, W, Os, Ru, Rh, Ir, Cr, Fe, Mo, V, Re, Mn, Nb, Ta, oxides and sulfides of the forgoing, and alloys of combinations thereof.

11. The method of claim 1 wherein said nitrogen dissociating electrocatalyst is selected as an electrocatalyst that preferentially dissociates diatomic nitrogen in favor of dissociating ammonia.

12. The method of claim 1 wherein the nitrogen dissociating electrocatalyst is selected from the group consisting of Pt, Pd, Ni, Co, Cu, Ag, W, Os, Ru, Rh, Ir, Cr, Fe, Mo, V, Re, Mn, Nb, Ta, oxides and sulfides of the forgoing, and alloys of combinations thereof.

13. The method of claim 1 wherein the voltage is applied across the proton conducting electrolyte by using the water vapor dissociating electrocatalyst and the nitrogen dissociating electrocatalyst as electrodes.

14. The method of claim 1 wherein at least one proton conducting electrolyte is provided in a tubular geometry.

15. The method of claim 1 wherein at least one proton conducting electrolyte is provided in a planar geometry.

16. The method of claim 1 further comprising the steps of e. decomposing the water vapor to produce protons and oxygen after the step of exposing the first side of the proton conducting electrolyte to water vapor, f. transferring the protons from the first side of the proton conducting electrolyte to the second side of the proton conducting electrolyte, and g. forming ammonia after the step of exposing the second side of the proton conducting electrolyte to nitrogen.

17. The method of claim 16 wherein the water vapor is provided in a first loop.

18. The method of claim 17 wherein oxygen formed by decomposing water vapor is removed from the water vapor present in the first loop.

19. The method of claim 16 wherein the nitrogen is provided in a second loop.

20. The method of claim 19 wherein ammonia is separated from the nitrogen present in the second loop.

21. A method for synthesizing anhydrous ammonia comprising the steps of: p1 a. providing a proton conducting electrolyte of barium cerium oxide doped with about 10% ytterbium having a first side and a second side, b. providing the first side of the proton conducting electrolyte in contact with a water vapor dissociating electrocatalyst selected from the group consisting of Ni, Pd,and combinations thereof, c. providing the second side of the proton conducting electrolyte in contact with a nitrogen dissociating electrocatalyst selected from the group consisting of Co, Ru, and combinations thereof, d. providing a voltage across the proton conducting electrolyte, e. exposing the first side of the proton conducting electrolyte to water vapor, and f. exposing the second side of the proton conducting electrolyte to nitrogen at a pressure of between about 10 atm and about 300 atm.

* * * * *